US008508380B2

(12) United States Patent
Marron et al.

(10) Patent No.: US 8,508,380 B2
(45) Date of Patent: Aug. 13, 2013

(54) DEVICE FOR DETECTING THE OPENING OF A HATCH IN AN ITEM OF EQUIPMENT COMPRISING ONE OR MORE ELECTRONIC CIRCUIT BOARDS

(75) Inventors: Christophe Marron, Cholet (FR); Marc Abadie, Cholet (FR); David Gribovalle, Saint Sebastien sur Loire (FR); Pierre Borrat-Michaud, Angers (FR)

(73) Assignee: Thales, Neuilly sur Seine (FR)

( * ) Notice: Subject to any disclaimer, the term of this patent is extended or adjusted under 35 U.S.C. 154(b) by 321 days.

(21) Appl. No.: 12/829,557

(22) Filed: Jul. 2, 2010

(65) Prior Publication Data

US 2011/0024427 A1 Feb. 3, 2011

(30) Foreign Application Priority Data

Jul. 3, 2009 (FR) ..... 09 03287

(51) Int. Cl.
*G08B 21/00* (2006.01)

(52) U.S. Cl.
USPC ..... 340/686.1; 340/687; 340/6.1; 439/66; 439/817

(58) Field of Classification Search
USPC ..... 340/686.1, 686.2; 361/616; 439/66, 439/817; 200/61.41, 61, 52 R
See application file for complete search history.

(56) References Cited

U.S. PATENT DOCUMENTS 4,303,735 A * 12/1981 Kehrer et al. ..... 428/391
4,654,754 A * 3/1987 Daszkowski ..... 361/708
5,049,813 A * 9/1991 Van Loan et al. ..... 324/754.14
5,103,378 A * 4/1992 Stowers et al. ..... 361/802
5,406,263 A * 4/1995 Tuttle ..... 340/572.1
5,831,351 A * 11/1998 Khosrowpour et al. ..... 307/139
5,938,472 A * 8/1999 Yuen et al. ..... 439/509
2008/0023316 A1 1/2008 Konishi et al.
2008/0317265 A1* 12/2008 Bouza et al. ..... 381/177

FOREIGN PATENT DOCUMENTS

CH 631572 A5 8/1982
DE 8616036 U1 10/1987
DE 9007135 U1 10/1990
EP 0624494 A1 11/1994

OTHER PUBLICATIONS

Preliminary Search Report and Written Opinion for corresponding French application No. 0903287 (issued Mar. 12, 2010).

* cited by examiner

*Primary Examiner* — Daniel Wu
*Assistant Examiner* — Frederick Ott
(74) *Attorney, Agent, or Firm* — Baker & Hostetler LLP

(57) ABSTRACT

The present invention relates to a device for detecting the opening of a hatch closing a case in an item of equipment including one or more electronic circuit boards, the planes of which are substantially orthogonal to the plane formed by the said hatch, at least one of the said boards including at least two conductive parts electrically insulated from one another and each connected to a detection circuit, a conductive element being attached to the inner side of the hatch, a portion of each of the conductive parts extending laterally to the side of the edge of the said electronic circuit board which is proximal to the hatch, the said conductive element being placed facing the said conductive parts so as to come into contact with them when the hatch is placed in the closed position.

4 Claims, 3 Drawing Sheets

DEVICE FOR DETECTING THE OPENING OF A HATCH IN AN ITEM OF EQUIPMENT COMPRISING ONE OR MORE ELECTRONIC CIRCUIT BOARDS

CROSS-REFERENCE TO RELATED APPLICATION

This application claims priority to foreign French patent application No. FR 09 03287, filed on Jul. 3, 2009, the disclosure of which is incorporated by reference in its entirety.

FIELD OF THE INVENTION

The present invention relates to a device for detecting the opening of a hatch in an item of equipment comprising one or more electronic circuit boards. It applies notably to the protection of cases comprising an access hatch placed orthogonally to the boards contained in the case.

BACKGROUND OF THE INVENTION

Items of electronic equipment are usually provided with access in the form of a hatch or a cover that can be removed so as to be able to work on the boards and/or circuits of the item of equipment, notably during a repair or an inspection. Nevertheless, the opening of such a hatch is usually reserved for very particular situations and must not be able to be carried out inappropriately or by an unauthorized person. Therefore, known devices make it possible to detect the inopportune opening of a hatch and then to raise an alarm or to neutralize the item of equipment when such an opening occurs. Conventionally, two techniques are adopted.

A first technique consists in the use of an electromechanical switch attached to an electronic circuit board situated inside the item of equipment. A nipple secured to the hatch pushes the switch down when the hatch is put in place, and then the switch is released with the removal of the hatch. This solution is well suited to the detection of opening of a hatch parallel to the plane of the electronic circuit boards. However, when the plane of the hatch is orthogonal to the planes of the electronic circuit boards contained in the item of equipment, it is necessary to employ a switch with large dimensions, impossible to house in a small space.

According to a second known technique, conductive spaces are reserved on an electronic circuit board and the hatch comprises an element that short-circuits these two spaces when it is put in place. This second technique is applicable when the electronic circuit boards are parallel to the hatch but is not suitable for a configuration in which the hatch is orthogonal to the boards.

SUMMARY OF THE INVENTION

One object of the invention is to propose a solution for detecting the opening of a hatch in an item of equipment comprising electronic circuit boards orthogonal to the said hatch, in particular when the space available for carrying out this detection is very small, of the order, for example, of a few $mm^2$. Accordingly, the subject of the invention is an item of equipment comprising a case, a hatch closing the case, one or more electronic circuit boards the planes of which are substantially orthogonal to the plane formed by the said hatch, and a device for detecting the opening of the hatch closing the case, the said device comprising a detection circuit and a conductive element, at least one of the said boards comprising at least two conductive parts electrically insulated from one another and each connected to the detection circuit, the conductive element being attached to the inner side of the hatch, the said device being characterized in that a portion of each of the conductive parts extends laterally to the side of the edge of the said electronic circuit board which is proximal to the hatch, the said conductive element being placed facing the said conductive parts so as to come into contact with them when the hatch is placed in the closed position.

According to one embodiment of the item of equipment according to the invention, the portion of each conductive part extending laterally to the edge of the electronic circuit board is flexible, the said portion being a preformed metal stem, strip or tongue curved in the shape of a "U", the two branches of the "U" of the said tongue being substantially parallel to the hatch. This configuration makes the contact between the conductive element and the conductive parts easier while ensuring that the device remains properly robust.

The conductive parts may be soldered to the electronic circuit board. Moreover, the conductive element attached to the inner side of the hatch may be a block of silicone laden with conductive particles. This material combines the characteristics of flexibility and electrical conductivity.

The conductive parts may be mounted on one and the same support maintaining the electric insulation between the said parts, the said support being attached to the electronic circuit board. This embodiment makes it easier to mount the two conductive parts while requiring, for example, only one soldering surface and/or while more easily controlling the space between the two conductive parts.

BRIEF DESCRIPTION OF THE DRAWINGS

Other features will appear on reading the following detailed description that is given as an example and is not limiting, with respect to appended drawings which represent.

DETAILED DESCRIPTION

For the purposes of clarity, the same reference numbers in different figures indicate the same elements.

Figure 1:
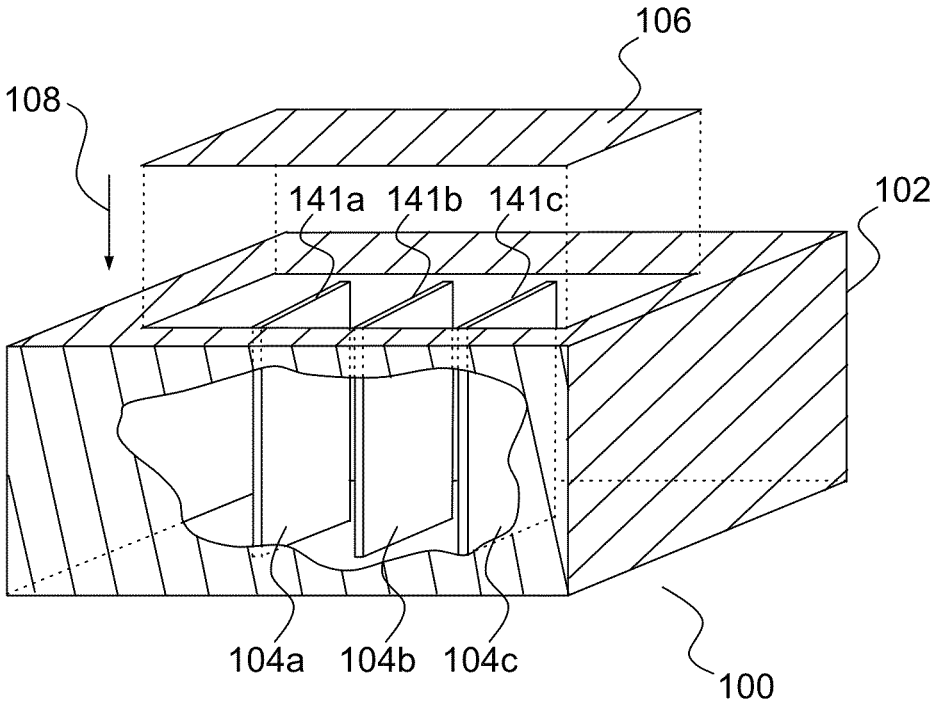
FIG. 1, a view in perspective of a configuration of the item of equipment for which the device according to the invention is suitable.

FIG. 1 shows a view in perspective of a configuration of the item of equipment for which the device according to the invention is suitable. The item of equipment 100 of FIG. 1 comprises a case 102 containing electronic circuit boards 104*a*, 104*b*, 104*c*, and a hatch 106 in the form of a removable plate providing access to the inside of the case 102. The arrow 108 indicates the direction of closure of the hatch 106. According to another possible configuration, the hatch 106 is held on one side of the case by attachment means, for example hinges.

The electronic circuit boards 104*a*, 104*b*, 104*c* are drawn in respective planes which are substantially orthogonal to the plane formed by the hatch 106. In other words, for each electronic circuit board 104*a*, 104*b*, 104*c*, the proximal portion of the inner side of the hatch 106 is a side 141*a*, 141*b*, 141*c* of the edge of the said board 104*a*, 104*b*, 104*c*. Moreover, because of the cramped and inextensible nature of the dimensions of the case 102 and because of the presence of many elements in the case 102 (printed circuit boards spaced only a few millimeters apart corresponding to the height of the electronic components attached to them, discrete components and connector plugs, for example), the space available for incorporating a device for detecting the opening of the hatch 106 is very restricted, for example of the order of a few mm2 of surface area on an electronic circuit board 104*a*.

Figure 2A:
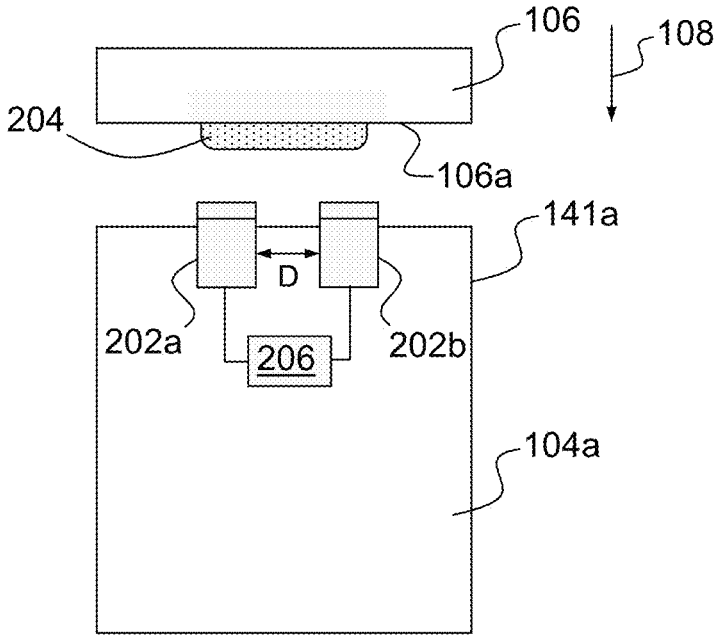
FIG. 2*a*, a front view of a first embodiment of the device according to the invention.
Figure 2B:
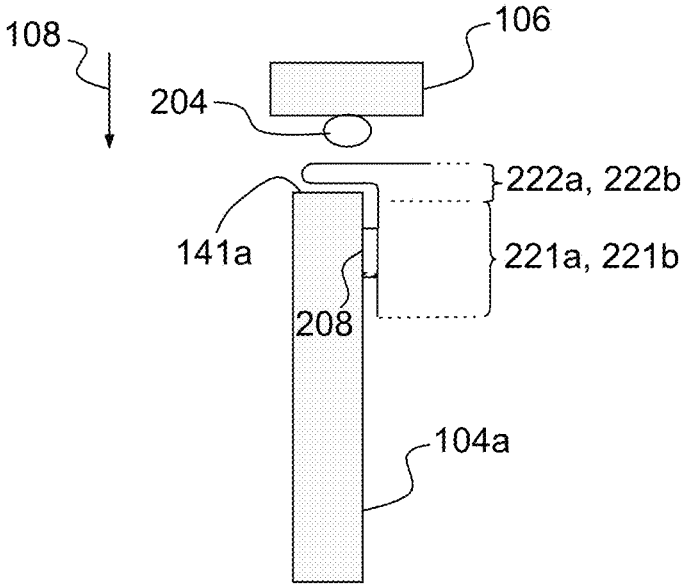
FIG. 2*b*, a side view of the first embodiment of the device according to the invention.

FIG. 2*a* shows a front view of a first embodiment of the device according to the invention and FIG. 2*b* shows a side view of this first embodiment. The device of the example comprises two electrically conductive parts 202*a*, 202*b* attached to an electronic circuit board 104*a*, for example a board specifically dedicated to security functions for the item of electronic equipment. The device according to the invention also comprises an electrically conductive element 204 attached to the inner side 106*a* of the hatch 106. In addition, each of the two parts 202*a*, 202*b* is connected to a processor module 206.

The electrically conductive element 204 is placed on the hatch 106 so that, when the hatch 106 is positioned in order to close the case of the item of equipment, this element 204 is pressed against the two conductive parts 202*a*, 202*b*, then establishing an electric link between the two parts 202*a*, 202*b* and closing the electric circuit with the processor module 206.

The processor module 206 is activated by the change of state of the electric circuit formed successively by the first conductive part 202*a*, the conductive element 204, and the second conductive part 202*b*. When the hatch 106 is in the closed position, the electric circuit is in the closed state because of the electric bridge established between the first part 202*a* and the second part 202*b*. The processor module 206 then considers this state to be normal, since the hatch 106 must be closed during the operation of the item of equipment. When the hatch 106 is open, the electric connection is broken between the two conductive parts 202*a*, 202*b*; the electric circuit switches to the "open" state, which is detected by the processor module 206, which can then raise the alarm or cause a neutralization of the item of equipment, for example.

The two conductive parts 202*a*, 202*b* are electrically insulated from one another while being, for example, separated by a short distance D. As an example, the conductive parts 202*a*, 202*b* have a width of 1 millimeter and a total length of a few millimeters. Each of the parts 202*a*, 202*b* is, for example, a metal stem, strip or tongue comprising a first portion 221*a*, 221*b* attached to the electronic circuit board 104*a* and a second portion 222*a*, 222*b* extending beyond the side 141*a* of the edge of the electronic circuit board 104*a* which is proximal to the inner side 106*a* of the hatch 106. The first portion 221*a*, 221*b* of each part 202*a*, 202*b* is, for example, soldered 208 to a side of the electronic circuit board 104*a*, preferably at the end close to the abovementioned side 141*a* of the edge of the board 104*a*. The second portion 222*a*, 222*b* of each part 202*a*, 202*b* extends in line with the first portion 221*a*, 221*b*, beyond the edge 141*a*. Advantageously, the shape of the second portion 222*a*, 222*b* is chosen to confer a flexibility on the part 202*a*, 202*b*, at least on an axis orthogonal to the hatch 106. For example, the second portion 222*a*, 222*b* of the part 202*a*, 202*b* is preformed in the shape of a "U", the two branches of the "U" being parallel to the plane formed by the hatch 106. Therefore, when the hatch 106 is closed, the parts withstand the permanent squashing due to the pressure of the conductive element 204 and the contact between the element 204 and the parts 202*a*, 202*b* is firmly maintained, preventing any risk of inopportune opening of the electric detection circuit.

Advantageously, the conductive element 204 is made of a flexible material, for example of silicone. In order to confer electrical conductive qualities on this element 204, metal particles may be disseminated throughout the silicone. Such a silicone block laden with particles forms a material that is both flexible and electrically conductive, suitable for use as a conductive element 204.

Figure 3:
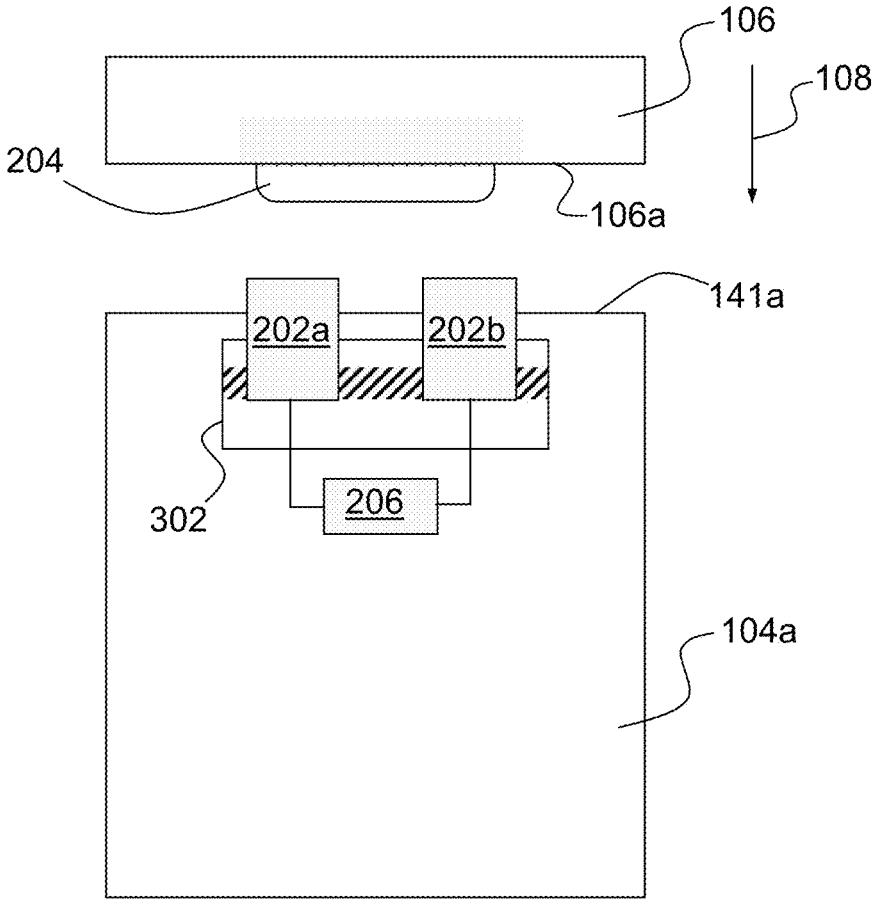
FIG. 3, a front view of a second embodiment of the device according to the invention.

FIG. 3 shows a front view of a second embodiment of the device according to the invention. According to this second embodiment, the conductive parts 202*a*, 202*b* are mounted on one and the same support 302 which is attached to the electronic circuit board 104*a*. This makes it easier to attach the said parts to the electronic circuit board 104*a*. Specifically, the spacing of the parts 202*a*, 202*b* relative to one another is more easily controlled and only one soldering surface is necessary in order to attach the support 302 and therefore the parts 202*a*, 202*b* to the electronic circuit board 104*a*. It is of course necessary to ensure that the support 302 does not conduct the electric current between the two parts 202*a*, 202*b*; the choice of an insulating material for producing the support 302 or the addition of an insulating material between the two parts is then carried out.

According to another embodiment, the processor module 206 is also placed on the support 302.

An advantage of the device according to the invention is that it does not take up very much room and can therefore be integrated into a very narrow space. Moreover, it requires no complex or fragile component (no sensor or contactor), which makes it easy to mass produce, but also able to withstand high temperatures and possible impacts sustained by the item of equipment, thus making it possible, for example, to install them in vehicles.

What is claimed is:

1. An item of equipment, comprising:

a case;

a hatch for closing the case;

one or more electronic circuit boards having a plane which is substantially orthogonal to a plane containing the hatch; and a device for detecting an opening of the hatch, wherein:

the device comprises a detection circuit and a conductive element, at least one of the one or more electronic circuit boards comprises at least two conductive parts electrically insulated from one another and each of the at least two conductive parts is connected to the detection circuit, the conductive element is attached to an inner side of the hatch, a portion of each of the at least two conductive parts is flexible and extends laterally to a side of an edge of the one or more electronic circuit boards which is proximal to the hatch, the portion of each of the at least two conductive parts is a preformed metal stem, strip or tongue curved in a U-shape having two branches, the two branches of the portion of each of the at least two conductive parts are substantially parallel to the hatch, and the conductive element faces the at least two conductive parts and comes into contact with the at least two conductive parts when the hatch is in a closed position.

2. The item of equipment according to claim 1, wherein the at least two conductive parts are soldered to the at least one of the one or more electronic circuit boards.

3. The item of equipment according to claim 1, wherein the conductive element attached to the inner side of the hatch is a block of silicone laden with conductive particles.

4. The item of equipment according to claim 1, wherein the at least two conductive parts are mounted on a same support maintaining an electric insulation between the at least two conductive parts, wherein the support is attached to the at least one of the one or more electronic circuit boards.

* * * * *